US007721361B1

(12) United States Patent
Shubert

(10) Patent No.: US 7,721,361 B1
(45) Date of Patent: May 25, 2010

(54) SPA ENCLOSURE APPARATUS

(76) Inventor: Gary L. Shubert, 22655 Brook Forest, Novi, MI (US) 48375

( * ) Notice: Subject to any disclaimer, the term of this patent is extended or adjusted under 35 U.S.C. 154(b) by 1172 days.

(21) Appl. No.: 11/328,796

(22) Filed: Jan. 10, 2006

Related U.S. Application Data

(63) Continuation-in-part of application No. 10/769,345, filed on Jan. 30, 2004, now abandoned.

(51) Int. Cl.
*E04H 4/00* (2006.01)

(52) U.S. Cl. ..... 4/498; 4/494

(58) Field of Classification Search ..... 4/498, 4/494; 135/123, 117, 125, 906, 908
See application file for complete search history.

(56) References Cited

U.S. PATENT DOCUMENTS

| | | | | |
|---|---|---|---|---|
| 653,621 | A | 7/1900 | Durham | |
| 669,740 | A | 3/1901 | Biddle | |
| 3,042,053 | A | 7/1962 | Effie | |
| 3,515,426 | A | 6/1970 | Gerber | |
| 3,854,149 | A * | 12/1974 | Mischke | 4/494 |
| 3,855,643 | A | 12/1974 | Sanford et al. | |
| 4,853,985 | A | 8/1989 | Perry | |
| 5,148,646 | A | 9/1992 | Lutostanski | |
| 5,745,932 | A | 5/1998 | Barovetto | |
| 5,974,599 | A | 11/1999 | Tudor | |
| 6,158,063 | A | 12/2000 | Tudor | |
| 6,859,952 | B2 * | 3/2005 | Perry | 4/498 |
| 6,938,281 | B1 * | 9/2005 | Tudor | 4/498 |
| 2007/0079434 | A1 * | 4/2007 | Pellerin | 4/498 |
| 2007/0210290 | A1 * | 9/2007 | Koren | 4/498 |
| 2008/0244820 | A1 * | 10/2008 | Moore | 4/498 |

* cited by examiner

*Primary Examiner*—Khoa D Huynh
(74) *Attorney, Agent, or Firm*—Howard & Howard Attorneys PLLC

(57) ABSTRACT

A spa enclosure apparatus has a convertible awning spanning over and spaced generally vertically from a hot tub when in use, and preferably an insulated cover assembly for covering the hot tub when not in use. Preferably, the cover assembly is engaged to and operates in conjunction with the convertible awning. The convertible awning has a canopy supported by and extending between two substantially parallel arcuate rods of the convertible awning. Each arcuate rod preferably connects to a substantially vertical shaft preferably of the cover assembly located substantially near respective rear corners of the spa. The arcuate rods extend upward from the vertical shafts, bend, and project over the hot tub to respective forward corners of the hot tub. Preferably, two substantially vertical columns of the convertible awning project upward from the vicinity of the respective forward corners to engage the distal ends of the arcuate rods.

13 Claims, 7 Drawing Sheets

SPA ENCLOSURE APPARATUS

RELATED APPLICATION

This application is a continuation-in-part of Ser. No. 10/769,345 filed Jan. 30, 2004 now abandoned, entitled "Convertible Enclosure for Spas."

TECHNICAL FIELD

The present invention relates generally to a hot-tub and more particularly to spa enclosure apparatus for use over the hot-tub.

BACKGROUND OF THE INVENTION

Hot tubs and/or spas typically utilized in the outside environment of a residential home contain heated water often circulated with numerous jets, and air bubblers that sooth and relax the bather. The inside liner of the tubs and spas typically form seats or lounging areas wherein the jets are strategically placed to massage specific areas of the bather. Because the spa is often located outside, it is exposed to seasonal weather changes that can be considerably colder than the heated temperature of the spa water. Consequently, cumbersome insulated covers are placed directly over the spa to minimize heat loss, preserve energy, and prevent water evaporation.

The weight and size of the insulated covers can create cover removal and placement difficulty for the bather. Consequently, cover removal devices are known that minimize the required lifting effort by the bather. One such device is disclosed in Perry, U.S. Pat. No. 4,853,985, filed Mar. 31, 1988, and in Tudor, U.S. Pat. No. 5,974,599, filed Jan. 9, 1998, both being incorporated herein by reference in their entirety.

Unfortunately, once the cover is removed and the bather(s) are relaxing within the hot tub or spa, the degree of privacy for the outdoor bather(s) is greatly minimized. Moreover, the bather when in the spa may be exposed to the harsh rays of the sun or bothered by surrounding insects and overhead birds. Yet further, falling debris from surrounding trees can clog the spa filter.

SUMMARY OF THE INVENTION

A spa enclosure apparatus has a convertible awning spanning over and spaced generally vertically from a hot tub when in use, and preferably an insulated cover assembly for covering the hot tub when not in use. Preferably, the cover assembly is engaged to and operates in conjunction with the convertible awning. The convertible awning has a canopy supported by and extending between two substantially parallel arcuate rods of the convertible awning. Each arcuate rod preferably connects to a substantially vertical shaft preferably of the cover assembly located substantially near respective rear corners of the spa. The arcuate rods extend upward from the vertical shafts, bend, and project over the hot tub to respective forward corners of the hot tub. Preferably, two substantially vertical columns of the convertible awning project upward from the vicinity of the respective forward corners to engage the distal ends of the arcuate rods.

The cover assembly has a cover preferably foldable and generally bisected by a joint into inward and outward wings for substantially vertical storage near the rear corners when in the removed position, and a spa removal mechanism preferably engaged to the cover at the joint. In a first embodiment, the shafts act generally as spokes and are part of the cover removal mechanism with hollow tubes engaged to and extending along the spokes for concentric receipt of the rods when the cover is in the removed position. In a second embodiment, the cover has a pocket in one of the wings that opens upward when in the removed position for storage of the convertible awning when the cover assembly is in covered position over the spa. The shafts of the cover assembly are preferably located in the pocket and project outwardly. The rods, which are telescoping and resiliently flexible, concentrically engage the shafts and project upward out of the pocket and resiliently bending over the spa and to the preferable columns. Preferably, both embodiments have a cross member extending substantially horizontally between the distal ends of the arcuate rods to add rigidity to the convertible awning when assembled.

Objects, features and advantages of this invention include a relatively inexpensive, robust, light weight and easily assembled convertible awning for a hot tub capable of utilizing pre-existing structure of a cover assembly. Moreover, the convertible awning is resistant to corrosion and moisture, capable of maintaining a taught canopy in changing weather conditions, protects the bather from harmful ultraviolet rays of the sun, provides bathing privacy, and is easily disassembled.

BRIEF DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION OF THE PREFERRED EMBODIMENTS

Figure 1:
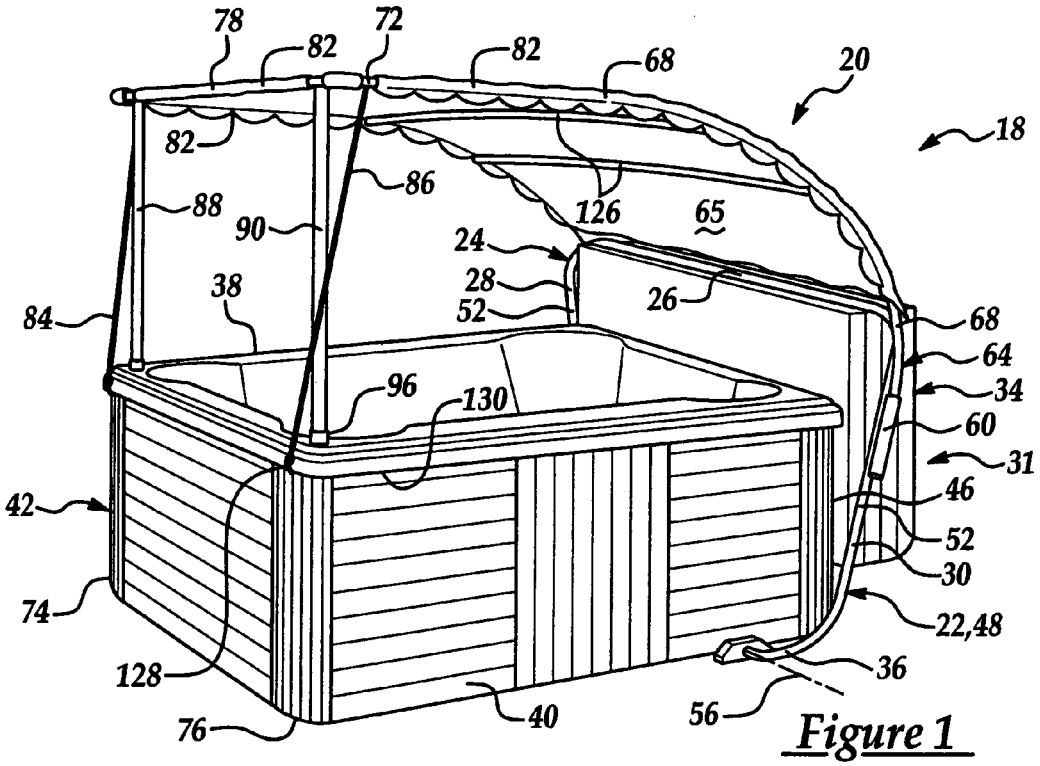
FIG. 1 is a forward perspective view of a spa enclosure apparatus embodying the present invention and utilized generally over a hot tub.

Referring to FIGS. 1-4, a spa enclosure apparatus 18 embodying the present invention is used generally as an accessory over a spa or hot-tub 42 that preferably stores heated water for recreational use. The spa enclosure apparatus 18 preferably has a cover assembly 31 that maintains water purity and temperature when the spa 42 is not in use and preferably a convertible awning 20 for sheltering occupants of the hot tub when in use. The convertible awning 20 generally moves or cooperates with the spa cover assembly 31 as dictated by a spa cover removal mechanism 22 of the spa cover assembly 31. One form of the spa cover removal mechanism 22 has a substantially U-shaped frame 24 that pivots about a pivoting axis 56 as it lifts and suspends the weight of a spa cover 34 of the spa cover assembly 31 thereby guiding the cover 34 between covered and removed positions, see U.S. Pat. No. 5,974,599, filed Jan. 9, 1998 and incorporated herein by reference in its entirety.

For compact storage when in the removed position, the cover 34 has a mid-section or joint 32 that generally bisects the folding spa cover 34 into a forward wing 33 and a rearward wing 35 that are connected to each other along the joint 32. When the cover 34 is in the covered position, the wings 33, 35 are spread and lie within a common, horizontal, imaginary plane and the U-shape of the frame lies near to this plane. When the cover 34 is in the removed position, the U-shape of the frame 24 is generally inverted and the wings 33, 35 are aligned or layered bottom-to-bottom, with respect to the covered position, and substantially vertical with the forward wing 33 located between a rear side 50 of the spa 42 and the rearward wing 35.

The U-shaped frame 24 is preferably tubular and unitary having a substantially horizontal upper portion or bar 26 extending between two shafts or spokes 28, 30 that project at least partially downward preferably on opposite sides 38, 40 of the spa 42 and to the pivoting axis 56. The substantially horizontal bar 26 connects to and co-extends with the joint 32 across the width of folding spa cover 34. The spokes 28, 30 are preferably L-shaped and lie within imaginary planes disposed substantially parallel to respective sides 38, 40 of the spa 42. Each spoke 28, 30 has an upper portion or stanchion 52 extending between the bar 26 and a lower portion or foot 36. The foot 36 is orientated at an approximate right angle to the stanchion 52 and projects therefrom to the pivoting axis 56 where the feet 36 are pivotally engaged to the respective left and right sides 38, 40 of the spa 42, or substantially near to the spa sides 38, 40, and slightly forward of respective left and right rear corners 44, 46 of the spa 42.

When the spa cover 34 is in an installed or closed position (not shown), the open perspective of the pivoting L-shaped spokes 28, 30 are opened generally in a forward and downward direction. As the spa cover removal mechanism 22 pivots toward the removed position 48, the bar 26 lifts the mid-section 32 of the cover 34 upward and rearward causing the cover 34 to fold upon itself, generally dangling the wings 33, 35 and then re-positioning into the removed position 48 orientating the wings 33, 35 adjacent to the rear side 50 of the spa 42. With the spa cover 34 in the removed position 48, the open perspective of the L-shaped spokes 28, 30 are directed in a slightly upward and substantially forward direction placing the stanchions 52 in a substantially vertical orientation yet angling slightly rearward as the stanchions project away from the axis 56 and to the bar 26, and with the respective feet 36 disposed substantially horizontal.

Referring to FIGS. 3-6, the convertible awning 20 of the spa enclosure apparatus 18 is integrated with the cover removal mechanism 22 of the cover assembly 31 via a pair of bases or hollow tubes 58, 60 engaged to and co-extending with the substantially straight stanchions 52 of the spokes 28, 30. When the cover assembly 31 is in the covered position, only the tubes 58, 60 of the convertible awning 20 are assembled to the removal mechanism 22. However, when the cover assembly 31 is in the removed position 48, the convertible awning 20 can then be easily and fully assembled. Moreover, by securing the hollow tubes 58, 60 directly to the surrounding ground or opposite sides 38, 40 of the spa 42, the convertible awning 20 can be used separate from the cover removal mechanism 22 enabling assembly of the awning regardless of the spa cover assembly 31 position.

Figure 5:
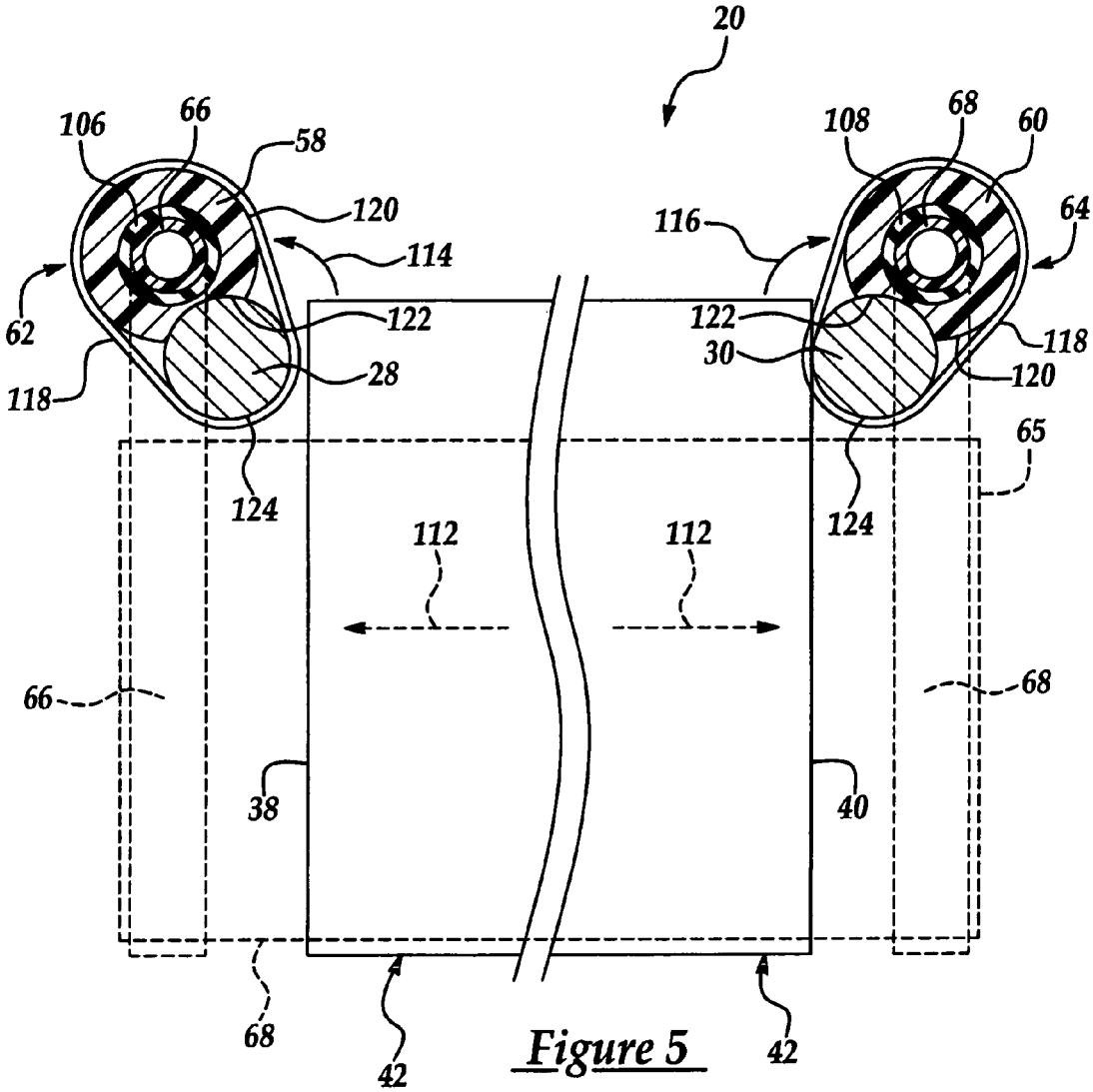
FIG. 5 is a cross section of the spa enclosure apparatus illustrating first and second support structures of the convertible awning shown assembled and taken along line 5-5 of FIG. 3.
Figure 9:
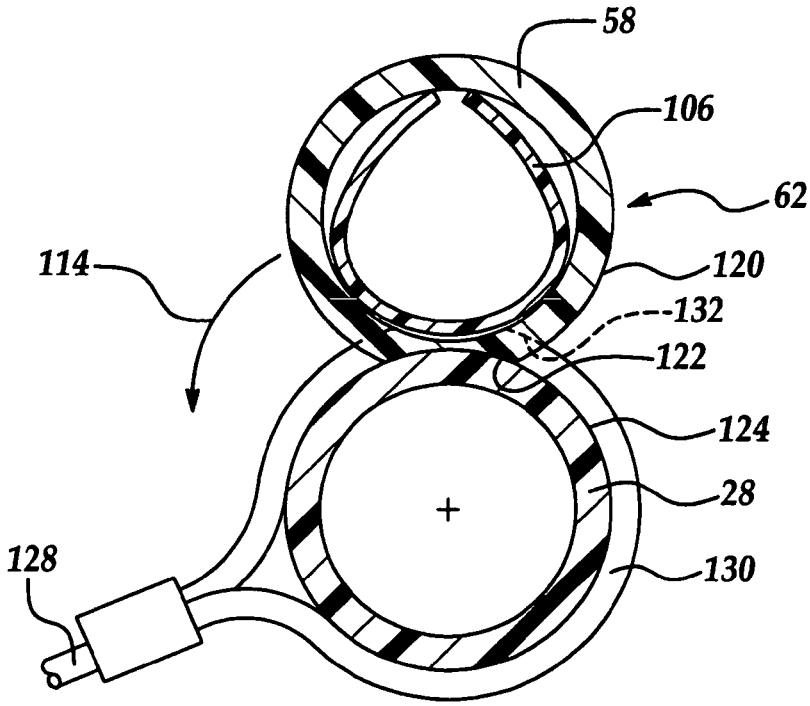
FIG. 9 is a partial cross section of the spa enclosure apparatus illustrating a base tube of the support structure engaged to a shaft of the cover removal mechanism with the arcuate rod of the support structure removed to show internal detail, and taken along line 9-9 of FIG. 4.
Figure 10:
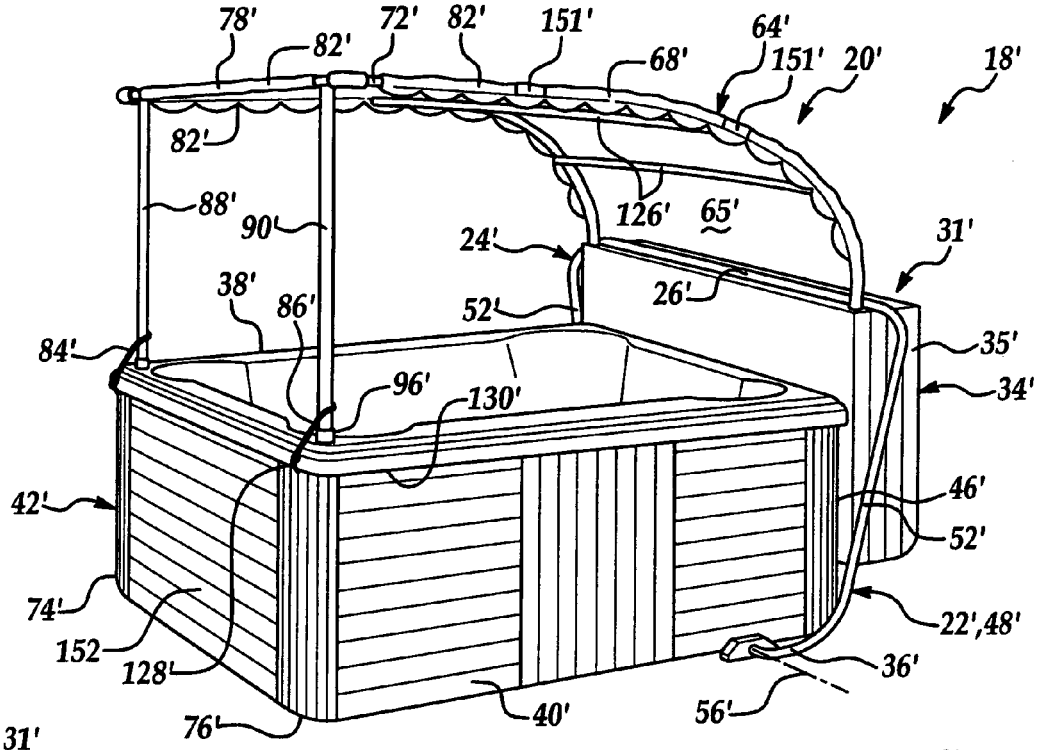
FIG. 10 is a forward perspective view of a second embodiment of a spa enclosure apparatus utilized generally over a hot tub.
Figure 11:
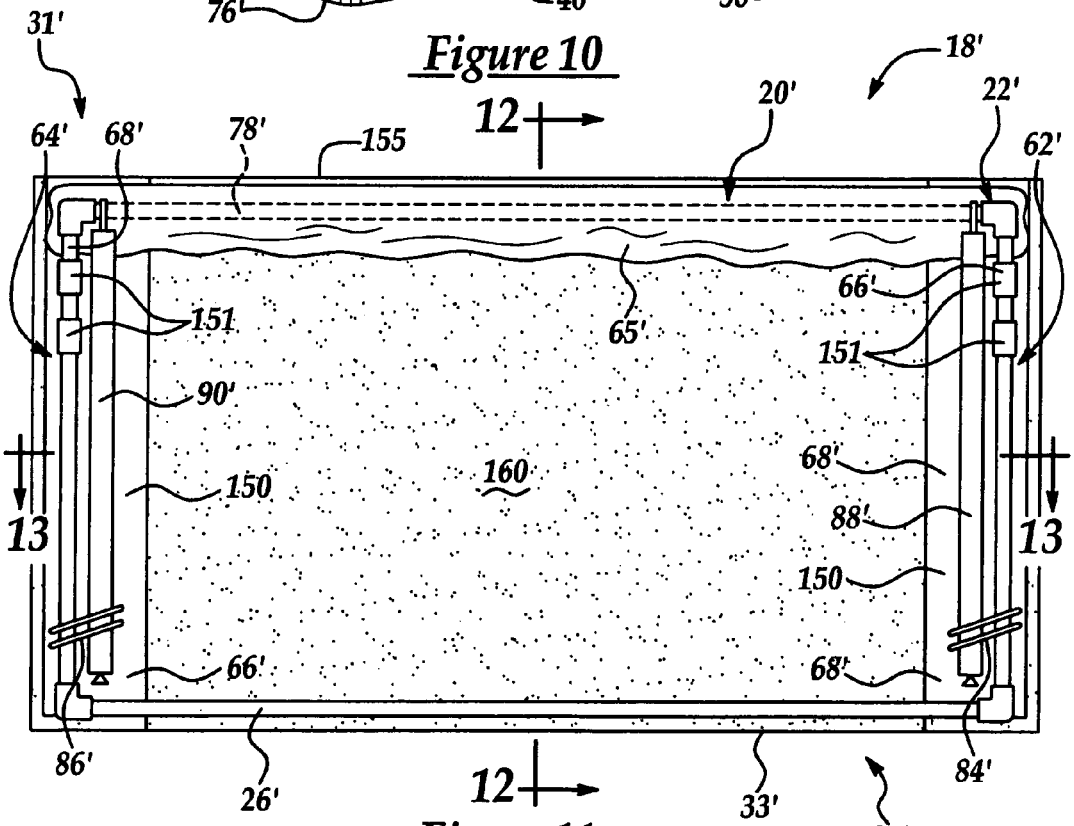
FIG. 11 is partial perspective view of the spa enclosure apparatus illustrating a cover of a cover assembly of the second embodiment with a panel of the cover removed to show internal detail further illustrating a convertible awning in a stored state.
Figure 12:
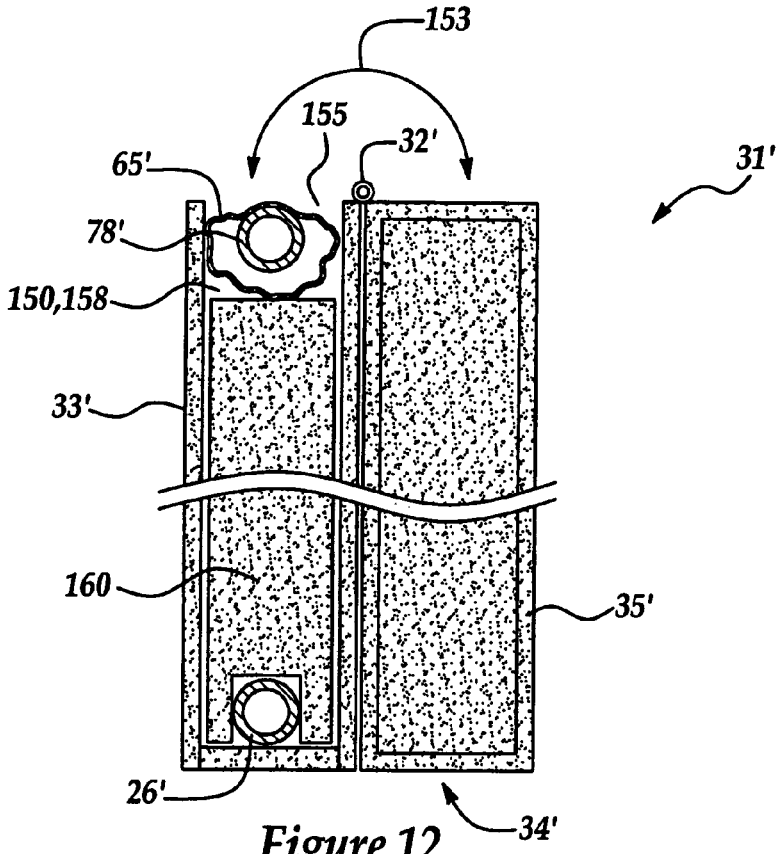
FIG. 12 is a cross section of the cover taken along line 12-12 of FIG. 11.
Figure 13:
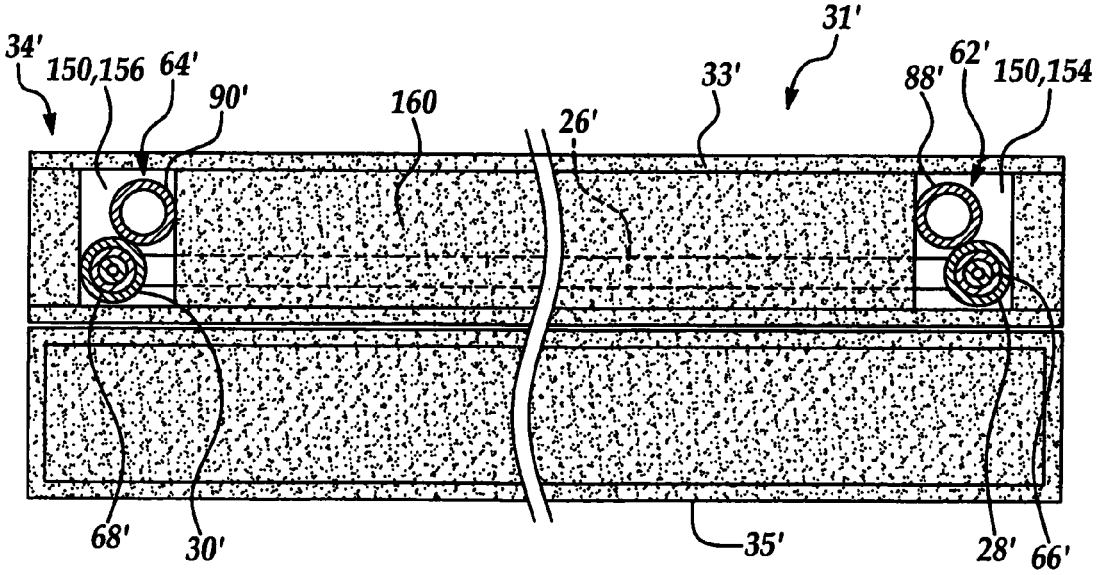
FIG. 13 is a cross section of the cover taken along line 13-13 of FIG. 11.

The left and right base tubes 58, 60 are part of respective left and right flexible whip devices or support structure 62, 64, that support an overhead canopy 65 of the convertible awning 20. Each structure 62, 64 has an arcuate rod 66, 68 extending between a preferably cylindrical base end 70, seated axially or longitudinally into the hollow base tubes 58, 60, and a distal end 72 spaced above respective left and right forward corners 74, 76 of the spa 42. Referring to FIGS. 5 and 9, the arcuate rods 66, 68 are held snugly within the tubes 58, 60 by friction inducing sleeves or sheets 106, 108 that are preferably made of a flexible plastic having a knurled or dimpled surface and are rolled and placed into the base tubes 58, 60. When the rods 66, 68 are seated axially into the tubes 58, 60 the rolled sheets 106, 108 are disposed radially between the respective rod and the tube.

Figure 6:
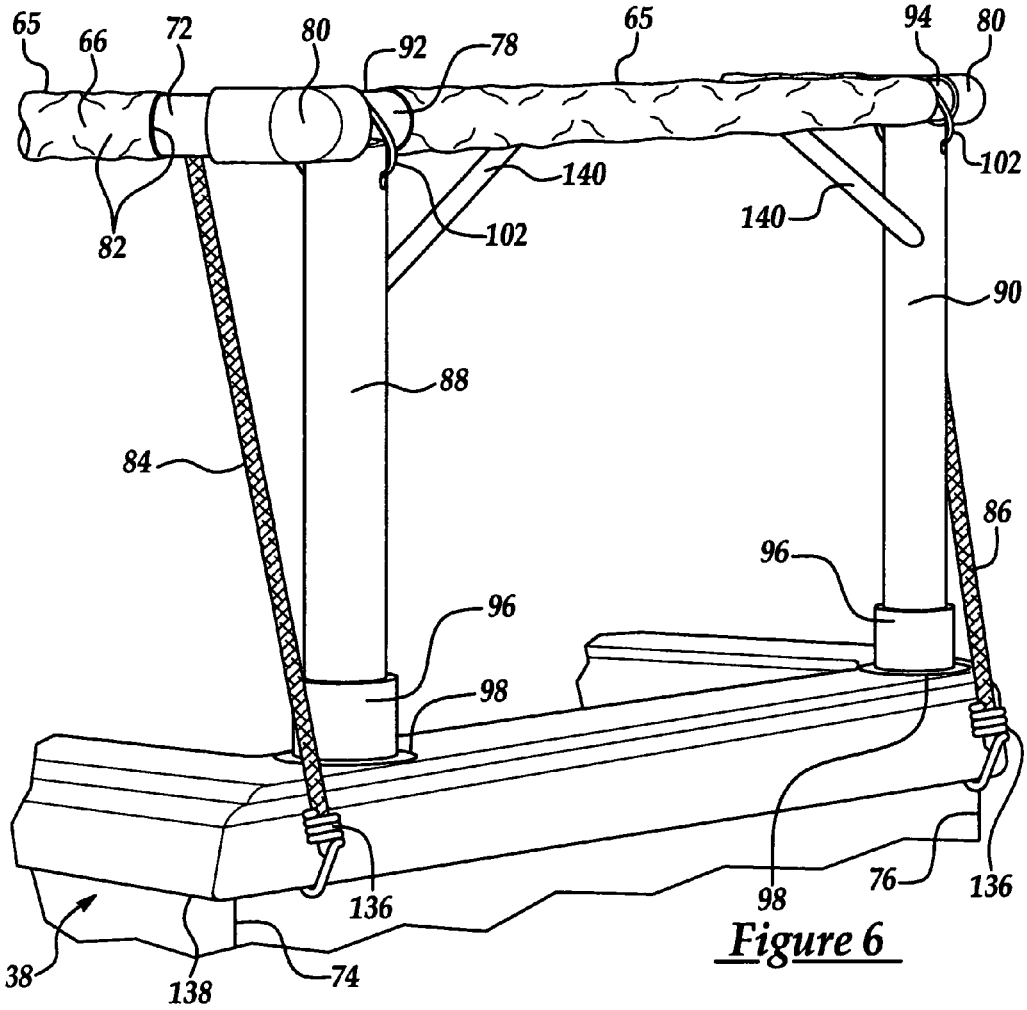
FIG. 6 is an enlarged partial perspective view of the convertible awning illustrating engagement of fasteners and vertical columns of the support structures.
Figure 7:
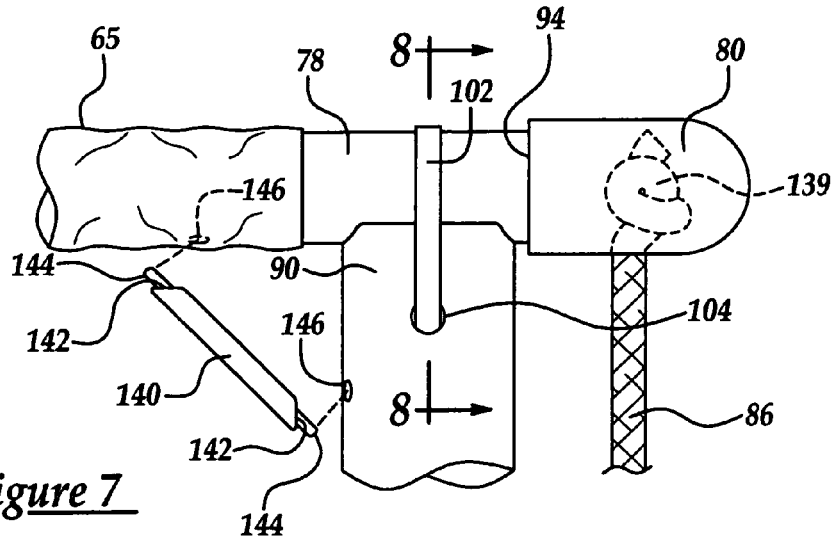
FIG. 7 is an enlarged partial front view of the convertible awning detailing engagement of the spacer column to a cross member of the convertible awning.
Figure 8:
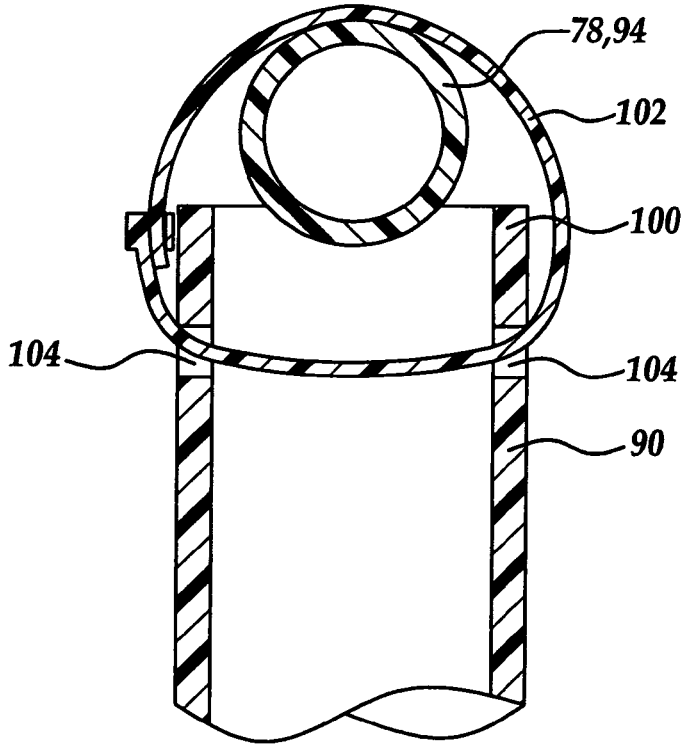
FIG. 8 is a partial cross section of the convertible awning illustrating engagement of the spacer column to the cross member when assembled and taken along line 8-8 of FIG. 7.

The rods 66, 68 can be yieldably flexible, bending resiliently from the base ends 70, or can be substantially rigid having elbows or fittings as needed to properly orientate the overhead canopy 65. Regardless, the arcuate rods 66, 68 project substantially upward from the tubes 58, 60 and bend over the spa 42 toward the forward corners 74, 76. A rigid elongated cross member 78 (as best shown in FIGS. 6-8) preferably extends between and engages to the two distal ends 72 maintaining a predefined space between the rods 66, 68. Preferably, the ends of the rigid cross member 78 engage the respective distal ends 72 of the rods 66, 68 via respective plastic ninety degree fittings or elbows 80. The cloth-like canopy 65 is stretched over the spa 42 and has a sleeve-like periphery 82 that receives the rods 66, 68 and cross member 78 or otherwise attaches generally continuously along the rods 66, 68, and the rigid cross member 78. Although not illustrated, it would now be conceivable to one skilled in the art to use the arcuate rods 66, 68 without the cross member 78, however, lateral strength of the rods 66, 68 would be lost thus reducing taughtness of the canopy 65.

Referring to FIGS. 6-8, the canopy 65 and arcuate rods 66, 68 are further stabilized by substantially vertical and rigid left and right columns 88, 90 engaged between respective forward corners 74, 76 of the spa 42 and opposite ends 92, 94 of the cross member 78 near the distal ends 72 of the left and right arcuate rods 66, 68. Releasable engagement of a bottom end 96 of each spacer column 88, 90 to the spa 42 is preferably achieved by suction cups 98 attached permanently to the bottom ends 96. A concave top end 100 of the column 88, 90 preferably connects to the cross member 78 via a fastener or plastic tie wrap 102 routed through a hole 104 communicating laterally through the column 88, 90, and encircling the cross member 78 (as best shown in FIG. 8).

If the rods 66, 68 are generally rigid and naturally curved, the columns 88, 90 are used to vertically space and support the weight of the canopy 65 over the spa 42. If the rods 66, 68 are resiliently flexed, the columns 88, 90 function primarily as vertical spacers and are preferably used in conjunction with two respective elongated fasteners or resiliently stretchable cords 84, 86 that connect substantially near the forward corners 74, 76 of the spa 42 and the distal ends 72 of the flexed rods 66, 68. In this instance, the columns 88, 90 do not support the weight of the canopy 65, and instead the cords 84, 86 are used to prevent the resiliently flexed rods 66, 68 from whipping up and back to a natural state. Because the resilient force of the flexible rods 66, 68 places the cords 84, 86 under tension, the cords 84, 86 can conceivably replace the rigid columns 88, 90 altogether. Although this would reduce the number of parts and the complexity of assembly, some lateral strength of the convertible awning 20 would be lost.

Referring to FIG. 5, although more costly to manufacture the convertible awning 20 having rods 66, 68 that are resiliently flexible, is that when the rods 66, 68 are in the flexed state, the biasing force of the rods 66, 68 can be used to further hold the canopy 65 laterally taught between the rods 66, 68. That is, the canopy 65 is pulled taught in a lateral direction with respect to the left and right flex rods 66, 68 and as designated by arrows 112. This lateral pull is created in-part by the tendency of the left tube 58 to slide circumferentially counter-clockwise with respect to the left shaft 28 (as designated by arrow 114) and the right tube 60 to slide circumferentially clock-wise with respect to the right shaft 30 (as designated by arrow 116). The circumferential slide of the tubes 58, 60 is induced by the forward flexing of the rods 66, 68 and the forward pull upon the whip devices 62, 64 created by the preferably bungee-type cords 84, 86.

Figure 3:
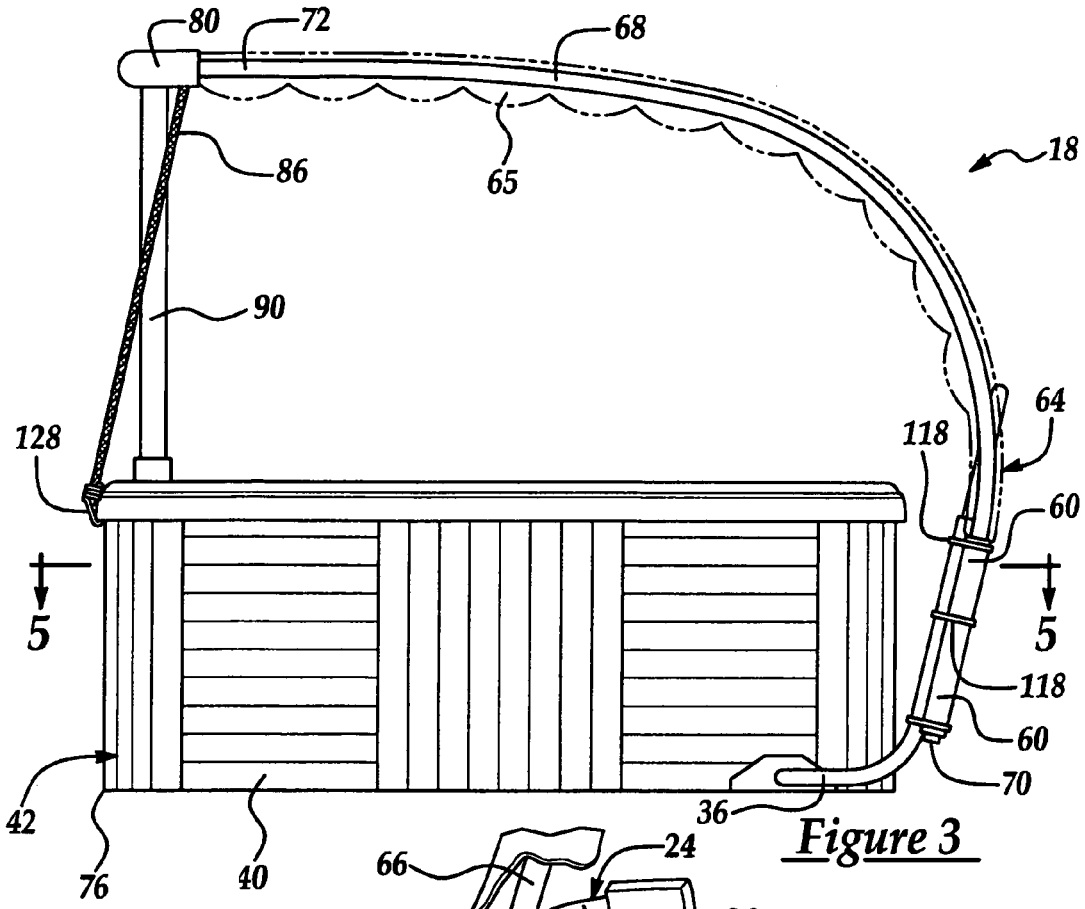
FIG. 3 is a side view of the spa enclosure apparatus.
Figure 4:
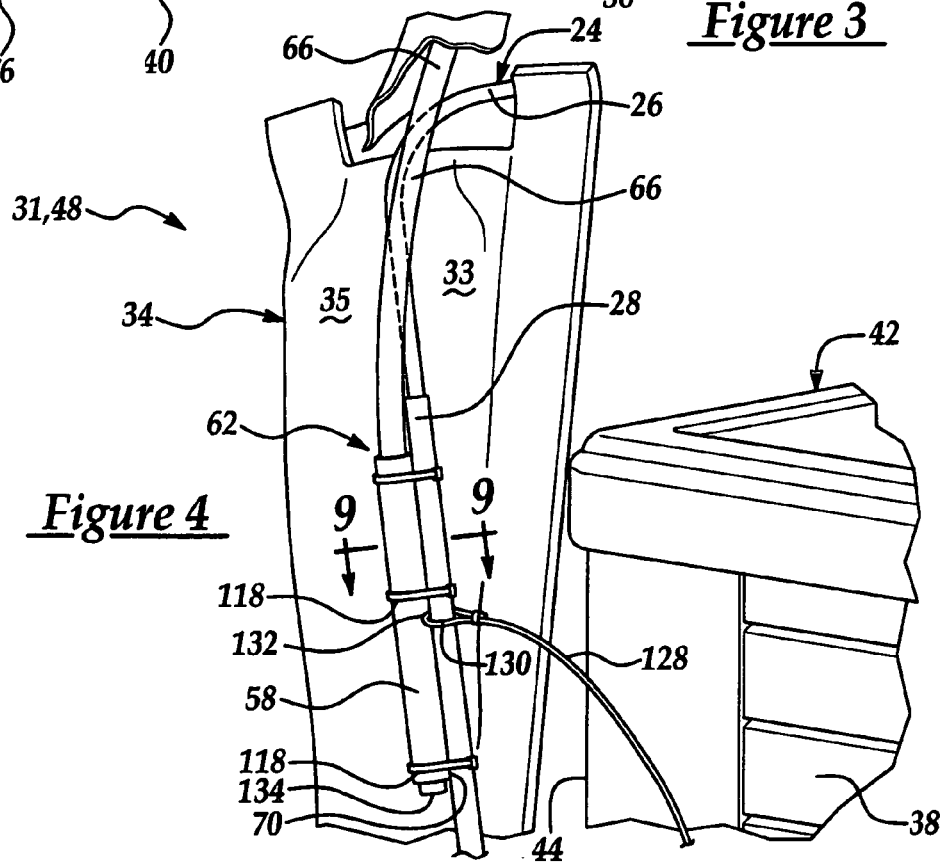
FIG. 4 is a partial enlarged view of the spa enclosure apparatus illustrating engagement of a convertible awning to a cover removal mechanism of a cover assembly.

During assembly of the convertible awning 20 with flexible rods 66, 68, positioning of the left tube 58 in a slightly less than twelve-noon position with respect to the left shaft 28, and the right tube 60 in a slightly greater than twelve-noon position with respect to the right shaft 30 not only assures the proper directions (arrows 114, 116) of circumferential slide to pull the canopy 65 taught, but also causes the flex rods 66, 68 to clear the U-shaped frame 24 when flexing forward (as best shown in FIGS. 3 and 4).

A series of axially spaced fastening bands or plastic tie wraps 118 hold the tubes 58, 60 laterally against the stanchions 52 of the left and right spokes 28, 30 of the spa cover removal mechanism 22, thus resisting the tendency of the base ends 70 of the rods 66, 68 to move rearward when the rods are flexed forward. Longitudinal skewing of the tubes 58, 60 with respect to the spokes 28, 30 is prevented by a contoured outer circumferential face 120 of the tubes that defines a longitudinally extending recess 122 having a radius of curvature that substantially conforms to the radius of the stanchions 52. The face 120 of the tubes 58, 60 thus slidably seats to an opposing circular surface 124 of the stanchions 52 at the recesses 122.

Also pulling the canopy 65 taught in a lateral direction with respect to the arcuate rods 66, 68 are a series of elongated spacer bows or spreader tubes 126. Each tube 126 extends laterally between the rods 66, 68 and are appropriately spaced apart from one-another to shape or contour the canopy 65 as needed to reflect or drain-off rain water and provide a pleasing wrinkle-free appearance to the canopy. Each spreader tube 126 is slightly longer than the distance between the rods 66, 68 thus creating the bow effect and maintaining the canopy 65 under a constant tension. T-shaped end portions of each spreader tube 126 has a C-shaped cross-section, contoured to snugly it and partially wrap about the cylindrical contour of each rod 66, 68. When assembling the convertible awning 20, the spreader tubes 126 are preferably installed last or after the arcuate rods 66, 68 are in position. To install, the user applies a force to resiliently bend the tube 126 generally at the middle to slip the tube 126 between the rods 66, 68. Release of this force causes the tube 126 to partially and resiliently flex back until the T-shaped end portions snugly fit or lock to the rods 66, 68. During disassembly of the convertible awning 20, re-applying the flexing force to the spreader tubes 126 will release the tubes 126 from the arcuate rods 66, 68.

Referring to FIG. 4, travel of the U-shaped frame 24 of the cover lilting mechanism 22 is limited by a pair of steel cables or tethers 128 secured between the respective sides 38, 40 of the spa 42 and the straight upper portions 52 of the spokes 28, 30 (see U.S. Pat. No. 6,158,063, incorporated herein by reference for further detail). The tethers 128 have a loop 130 which wraps securely about the spokes 28, 30. Preferably, the integrated convertible awning 20 utilizes the loops 130 as a type of circumferential rib to prevent axial movement of the tubes 58, 60 of the respective support structures 62, 64 with respect to the spokes 28, 30. Each tube 58, 60 carries a lateral outward groove 132 which seats the respective loops 130 of the tethers 128. Axial movement of the rods 66, 68 with respect to the tubes 58, 60 is prevented once assembled by a plug 134 engaged to the base end 70 of each tube 58, 60. Preferably, the plug 134 is threaded into the end of the tube 58, 60, however, it may also be molded as a unitary piece with the tube 58, 60, or secured in other ways such as adhesive. To prevent water from settling within the tubes 58, 60 when the convertible awning 20 is disassembled, each plug 134 preferably carries a hole (not shown) for water drainage. Keeping the tubes 58, 60 free of pooled water assures that freezing water will not damage the tubes 58, 60 during cold weather.

Referring to FIGS. 6 and 7, the forward portion of the convertible awning 20 is preferably further stabilized laterally by two angled flexible braces 140 which extend between and snap fit to the cross member 78 and respective spacer columns 88, 90. Each brace 140 has chamfered end faces 142 which conform to the contour of the cylindrical surface of the columns 88, 90 and cross member 78. Projecting axially outward from each face 142 is a pin 144 that snap fits into a corresponding hole 146 carried by the walls of the cross member 78 and spacer columns 88, 90.

Figure 2:
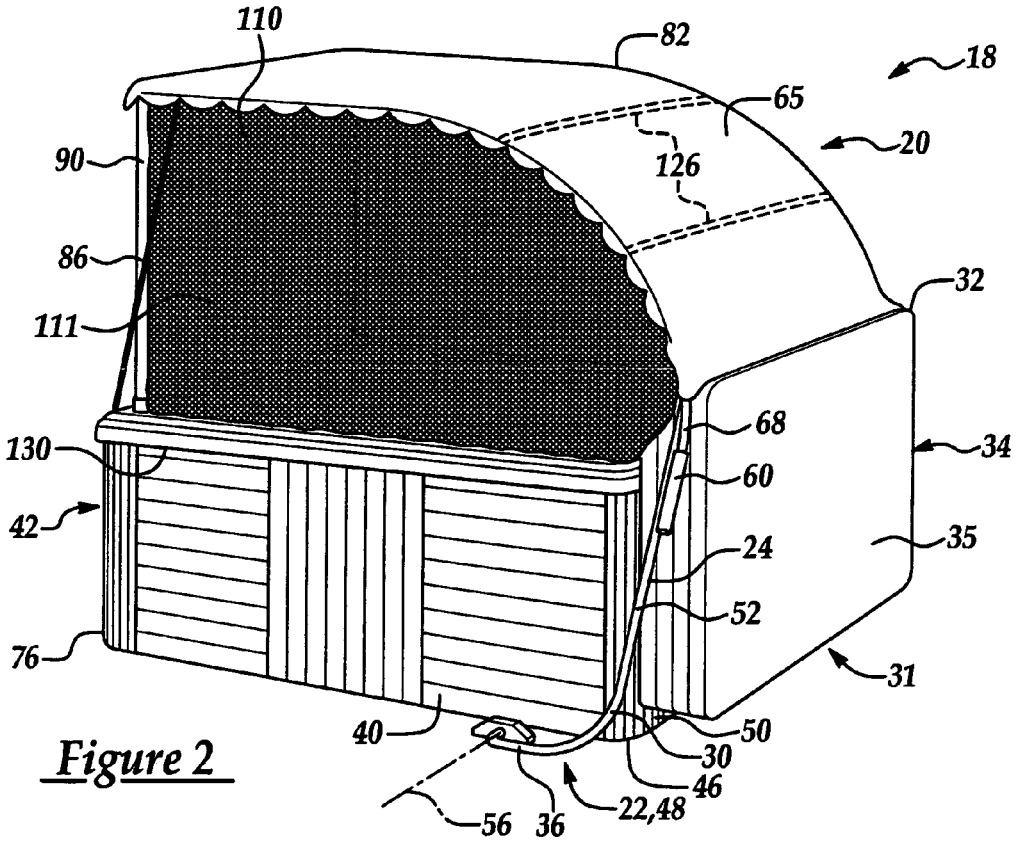
FIG. 2 is a rearward perspective view of the spa enclosure apparatus.

Referring to FIG. 2, the rigidity of the assembled arcuate rods 66, 68 (flexible or rigid), cross member 78 and vertical columns 88, 90 provide an ideal support structure for a surrounding screen or window-like enclosure 110 having a left panel draped downward from the left rod 66, a right panel 111 draped downward from the right rod 68 and a forward panel draped downward from the cross member 78. A rear panel is not required because of the curved orientation of the canopy 65 and rods 66, 68 that slope downward toward the spa 42 and folded cover 34, thus providing a degree of privacy. Preferably, the panels are attached releasably to the canopy 65 by a hook-and-loop fastener such as Velcro®.

Preferably, the tubes 58, 60, cross member 78, spacer columns 88, 90, rods 66, 68 and bows 126 are made of a non-corrosive, water resistant, plastic, such as PVC or CPVC piping. The arcuate rods 66, 68 and bows 126 are appropriately sized to possess a substantial degree of flexibility and may also be made of fiberglass or other materials, solid or otherwise. The fasteners 84, 86 are preferably elastic bungee cords or straps attached permanently to the distal ends 72 of the rods 66, 68. Each cord 84, 86 has an enlarged upper end or knot 139 (as best shown in FIG. 7) preferably disposed concealably inside the distal ends 72 of the hollow rods 66, 68. From the enlarged head, each cord 84, 86 generally projects downward and snugly through a hole in the pipe wall of the rods 66, 68 to removably engage a peripheral lip 138 of the hot tub 42 via rubber-coated steel hooks 136 connected to the lower cord ends.

Referring to FIGS. 10-13, a second embodiment of a spa enclosure apparatus 18' is illustrated wherein like components to the first embodiment have the same identifying numerals except with a prime symbol added for the second embodiment. In the second embodiment, a convertible awning 20' is constructed and arranged to be stored in a pocket 150 of a foldable cover 34' of a cover assembly 31'. Two telescoping and resiliently flexible rods 66', 68' of respective whip devices 62', 64' engage rigidly to and project concentrically from respective shafts 28', 30' located in the pocket 150 and engaged to the cover 34'. The telescoping rods 66', 68' are preferably made of a composite fiberglass and are similar to telescoping poles used for flag masts. One such pole is known as Wonder Pole®, supplied by American Flag & Banner Company, Salem, Oreg., of the United States. Preferably, each rod 66', 68' has two twistable grips 151 for releasably locking the rods in an extended position.

When the cover assembly 31' is in the removed position 48' and supported by a cover removal mechanism 22' of the cover assembly 31' the cover 34' is in a substantially vertical orientation. When vertical, the pocket 150 is generally open upwardly, thus the shafts 28', 30' and telescoping rods 66', 68' project substantially upward. When the cover assembly 31' is placed into a covered position directly over the hot tub 42' (not shown) the cover 34' is unfolded (see arrow 153 of FIG. 12) and is substantially horizontal. When horizontal, the shafts 28', 30' and telescoping rods 66', 68' are also substantially horizontal and concealed by the unfolded cover in the pocket 150.

Preferably, the cover 34' is foldable along a joint 32' that bisects the cover 34' into inward and outward wings 33', 35' with respect to a rear side of the hot tub 42'. The pocket 150 is in one of the wings 33', 35' and opens upwardly alongside the joint 32' when the cover assembly 31' is in the removed position 48' thus positioning the wings 33', 35' vertically. When the cover assembly 31' is in the covered position, the wings 33', 35' are substantially horizontal lying along the same imaginary plane and the joint 32' is folded generally in upon itself, thus concealing the pocket 150 that contains the disassembled or stored convertible awning 20'.

When the cover assembly 31' is in the removed position 48' and the convertible awning 20' is being assembled from its stored state, the resiliently flexible and telescoping rods 66', 68' of the whip devices 62', 64' are expanded longitudinally out of the pocket 150 carrying a rigid cross member 78' that extends between distal ends of the rods 66', 68', with it. As the rods 66', 68' expand longitudinally, a canopy 65' that is generally bunched-up in the pocket 150 when stored, spreads out laterally between the rods 66', 68' and longitudinally between the cover 34' and cross member 78'. Once the rods 66', 68' are extended, the grips 151 are tightened to lock the rods 66', 68' in place.

Also during extension of the telescoping rods 66', 68', two columns 88', 90' of the whip devices 62', 64', are carried out of, the pocket 150 generally by the cross member 78'. Once extracted from the pocket 150, the columns 88', 90' are rotated approximately ninety degrees about the cross member 78'. With rotation of the columns 88', 90' the resilient rods 66', 68' are flexed approximately ninety degrees over the respective left and right sides 38', 40' of the hot tub 42' and toward a front side 152 of, the hot tub 42' orientated substantially parallel to the cross member 78'. Once the rods 66', 68' are flexed, the columns 88', 90' project substantially downward to left and right corners 74', 76' of the hot tub 42'.

Engaged at or near to the bottom ends 96' of the columns 88', 90' are preferably elastic fasteners 84', 86' such as bungee cords that releasably hook to the forward corners 74', 76' of the hot tub 42'. This prevents the resilient force of the flexed rods 66', 68' from lifting the spacer columns 88', 90' off of the hot tub 42'. When the convertible awning 20' is being disassembled or stored, and prior to complete retraction of the telescoping rods 66', 68', the columns 88', 90' are rotated approximately ninety degrees about the cross member 78' longitudinally aligning the columns 88', 90' with the unflexed rods 66', 68', whereupon the bungee cords 84', 86', still engaged to the ends 96' of the columns 88', 90', are wrapped about the respective rods 66', 68'. The rods 66', 68' are then completely retracted placing the cords 84', 86' deep within the pocket 150 as the canopy 65' is re-bunched against the cross member 78' and placed into the pocket 150 near its opening 155.

The pocket 150 is preferably located in the inward or forward wing 33' of the cover 34' thus utilizing the outward or rearward wing 35' as a counter-weight to resist the resilient reactive force of the telescoping rods 66', 68' when fully extended and flexed. Moreover, if the cover removal mechanism 22' of the cover assembly 31' is of a type that firmly holds the forward wing 33' in a substantially vertical position when the cover assembly 31' is in the removed position 48', the countering effect of the outward wing 35' may not be necessary, thus enabling the pocket 150 to be carried by the outward wing 35. If so located, the rods 66', 68' would have a greater distance to flex thus requiring a somewhat smaller force to perform the flexing, while creating a user handy shelf (not shown) created by the inward wing 33' when in the removed position 48' and generally along the joint 32'.

Preferably, the pocket 150 is generally U-shaped and inverted when the cover assembly 31' is in the removed position. When inverted, the U-shaped pocket 150 has first and second vertical leg portions 154, 156 that store respective first and second rods 66', 68' and columns 88', 90', and a horizontal portion 158 that communicates with the leg portions 154, 156 and generally stores the cross member 78' and bunched canopy 65'. The cover 34' is substantially made of a preferably closed-cell insulating material that is resistant to moisture. To maximize the cover's insulating ability, the pocket 150 is not any larger than that needed to store the convertible awning 20'. Thus, preferably an insulating panel 160 spans between the leg portions 154, 156 for added structural rigidity and insulation. Providing lateral rigidity between the whip devices 62', 64' is a lateral internal support or bar 26' that attaches between bottom ends of the shafts 28', 30' and is substantially encased by the panel 160.

While the forms of the invention herein disclosed constitute a presently preferred embodiment, many others are possible. For instance, the shafts 28, 30 need not take the form of spokes in the spa cover removal mechanism 22, but can function as stakes projecting rigidly upward from grade at opposite sides of the spa. Consequently, if the shafts 28, 30 function as stakes secured firmly to the surrounding grade or directly to the spa itself, the convertibly awning 20 can remain assembled over the spa 42 even when the cover 34 is in the covered position. It is not intended herein to mention all the possible equivalent forms or ramifications of the invention. It is understood that terms used herein are merely descriptive, rather than limiting, and that various changes may be made without departing from the spirit or scope of the invention as defined by the following claims.

The invention claimed is:

1. A spa enclosure apparatus for use over a hot tub or a spa having a first side and an opposite second side, the spa enclosure apparatus comprising:

a spa cover removal mechanism having a first shaft located pivotally at the first side of the spa, a second shaft located pivotally at the opposite second side of the spa, a covered position wherein a cover of the spa is placed directly over the spa, and a removed position wherein the cover is off of the spa and the first and second shafts project substantially vertically;

a convertible awning including:

a first removable flex rod projecting upward from the first shaft and resiliently bent over the spa when the spa cover removal mechanism is in the removed position;

a second removable flex rod projecting upward from the second shaft and resiliently bent over the spa when the spa cover removable mechanism is in the removed position;

a canopy spaced above the spa and engaged between the first and second flex rods;

a distal end of the first flex rod;

a distal end of the second flex rod;

a cross member spaced above the spa and engaged between the distal ends of the first and second flex rods; and a vertical spacer column engaged between the spa and the cross member.

2. The spa enclosure apparatus set forth in claim 1 comprising a tie wrap for fastening the spacer column to the cross member.

3. The spa enclosure apparatus set forth in claim 1 comprising panels draped downward from the canopy.

4. A convertible spa enclosure apparatus for use over a hot tub having a first side, and opposite second side, and rear and front sides extending between the first and second sides, the convertible spa enclosure apparatus comprising:

a spa cover assembly having a cover having a substantially horizontal covered position wherein the cover is directly over the hot tub when the hot tub is not in use and a substantially vertical removed position wherein the cover extends between the first and second sides and along the rear side when the hot tub is in use, and a first mounting shaft and a second mounting shaft constructed and arranged to at least in-part project substantially upward near the rear side when the cover is in the removed position;

a convertible awning at least in-part spaced above the hot tub for sheltering occupants when the hot tub is in use, the convertible awning having an elongated, arcuate, support structure projecting upward from the first and second mounting shafts and spaced over the hot tub, the support structure extending between the rear and front sides when the cover is in the removed position, and a canopy supported by the support structure and at least in-part spaced above and spanning over the hot tub;

a pocket in the cover opened upwardly when the spa cover assembly is in the removed position;

the first and second mounting shafts being located in the pocket; and the support structure having a first telescoping rod and a second telescoping rod engaging the first and second mounting shafts respectively such that when the first and second telescoping rods are extended, the rods project upward from the first and second mounting shafts respectively and are flexed over the hot tub and project to a distal end spaced above the front side, and when the first and second telescoping rods are retracted, the rods are stored in the pocket.

5. The spa enclosure apparatus set forth in claim 4 further comprising:

the support structure having a column extending vertically between the hot tub near the front side and the distal end of at least one of the first and second telescoping rods.

6. The spa enclosure apparatus set forth in claim 5 wherein the first and second telescoping rods are resiliently flexed in order to project over the spa toward the front side.

7. The spa enclosure apparatus set forth in claim 5 further comprising the spa cover assembly having a cover removal mechanism constructed and arranged to hold the cover substantially vertical when in the removed position.

8. The spa enclosure apparatus set forth in claim 7 wherein the cover removal mechanism has the first and second mounting shafts engaging pivotally at a lower end to the hot tub, and wherein a base end of the first and second telescoping rods laterally attach removably to and co-extends axially with the first and second mounting shafts respectively.

9. The spa enclosure apparatus set forth in claim 4 wherein the cover assembly has a cover removal mechanism constructed and arranged to secure the cover vertically when in the removed position.

10. The spa enclosure apparatus set forth in claim 8 further comprising a fastener engaged to the support structure near the front side and engaged removably to the hot tub to maintain the flexed condition of the first and second telescoping rods.

11. The spa enclosure apparatus set forth in claim 10 further comprising a first spacer column and a second spacer column projecting downward from the distal end of the first and second telescoping rods respectively and to a bottom end of the first and second spacer columns contacting the hot tub near the front side and wherein the fastener is engaged to the bottom end.

12. The spa enclosure apparatus set forth in claim 11 wherein the first and second spacer columns are constructed and arranged to rotate with respect to the distal end of the first and second telescoping rods respectively and are disposed parallel to the first and second telescoping rods and stored in the pocket when the first and second telescoping rods are retracted.

13. The spa enclosure apparatus as set forth in claim 4 further including a cross member spaced above the hot tub and engaged between the distal end of each of the first and second telescoping rods.

* * * * *